US009022821B2

(12) United States Patent
Matsushita

(10) Patent No.: US 9,022,821 B2
(45) Date of Patent: May 5, 2015

(54) CRIMPED CONNECTION OF A WIRE WITH A TERMINAL HAVING VAPOR DEPOSITED FILM

(71) Applicant: Yazaki Corporation, Tokyo (JP)

(72) Inventor: Kouichiro Matsushita, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/023,529

(22) Filed: Sep. 11, 2013

(65) Prior Publication Data

US 2014/0011411 A1 Jan. 9, 2014

Related U.S. Application Data

(63) Continuation of application No. PCT/JP2012/063406, filed on May 18, 2012.

(30) Foreign Application Priority Data

May 20, 2011 (JP) ..... 2011-113868

(51) Int. Cl.

| | |
|---|---|
| ***H01R 13/02*** | (2006.01) |
| ***H01R 4/10*** | (2006.01) |
| ***H01R 4/20*** | (2006.01) |
| ***H01R 4/18*** | (2006.01) |
| ***H01R 4/62*** | (2006.01) |

(Continued)

(52) U.S. Cl.

CPC ..... *H01R 4/20* (2013.01); *H01R 4/185* (2013.01); *H01R 4/62* (2013.01); *H01R 13/03* (2013.01); *H01R 43/16* (2013.01)

(58) Field of Classification Search

CPC ..... H01R 13/02; H01R 9/24; H01R 4/20; H01R 4/183–4/188

USPC ..... 439/877–879, 886, 887

See application file for complete search history.

(56) References Cited

U.S. PATENT DOCUMENTS

| | | | | |
|---|---|---|---|---|
| 2,503,429 | A * | 4/1950 | Ziegler | 310/344 |
| 3,417,366 | A * | 12/1968 | Holton et al. | 174/75 R |
| 5,888,323 | A * | 3/1999 | Yasukuni et al. | 156/48 |

(Continued)

FOREIGN PATENT DOCUMENTS

| | | |
|---|---|---|
| GB | 2349018 A | 10/2000 |
| JP | 2000299140 A | 10/2000 |

(Continued)

OTHER PUBLICATIONS

International Search Report (PCT/ISA/210), dated Aug. 24, 2012, issued by the International Searching Authority in counterpart International Patent Application No. PCT/JP2012/063406.

(Continued)

*Primary Examiner* — Chandrika Prasad

(74) *Attorney, Agent, or Firm* — Sughrue Mion, PLLC

(57) ABSTRACT

In a structure of a crimping connection part of an aluminum electric wire and a metal terminal, the aluminum electric wire includes a core wire and an insulating sheath covering the core wire, an exposed core wire in which the core wire is exposed from the insulating sheath at an end portion of the aluminum electric wire is crimped by a core wire crimping part of the metal terminal to form the crimping connection part, and the exposed core wire and the metal terminal of the crimping connection part are covered by a vapor deposited film comprised of an electrically conductive powder.

12 Claims, 2 Drawing Sheets

(51) Int. Cl.
*H01R 13/03* (2006.01)
*H01R 43/16* (2006.01)

(56) References Cited

U.S. PATENT DOCUMENTS

| | | | | |
|---|---|---|---|---|
| 6,334,798 | B1 * | 1/2002 | Ushijima et al. | 439/879 |
| 7,591,666 | B2 * | 9/2009 | Legrady et al. | 439/424 |
| 2002/0028612 | A1 | 3/2002 | Ushijima et al. | |

FOREIGN PATENT DOCUMENTS

| | | | |
|---|---|---|---|
| JP | 2010-55901 | A | 3/2010 |
| JP | 2010-108798 | A | 5/2010 |
| JP | 2010-238393 | A | 10/2010 |
| JP | 2011-86431 | A | 4/2011 |
| WO | 2009/096591 | A1 | 8/2009 |
| WO | 2009/102074 | A1 | 8/2009 |

OTHER PUBLICATIONS

Written Opinion (PCT/ISA/237), dated Aug. 24, 2012, issued by the International Searching Authority in counterpart International Patent Application No. PCT/JP2012/063406.

Office Action dated Jan. 15, 2015, issued by the Korean Intellectual Property Office in counterpart Korean Application No. 10-2013-7026261.

* cited by examiner

CRIMPED CONNECTION OF A WIRE WITH A TERMINAL HAVING VAPOR DEPOSITED FILM

CROSS REFERENCE TO RELATED APPLICATIONS

This application is a continuation of PCT application No. PCT/JP2012/063406, which was filed on May 18, 2012 based on Japanese Patent Application (No. P2011-113868) filed on May 20, 2011, the contents of which are incorporated herein by reference.

BACKGROUND OF THE INVENTION

1. Field of the Invention

The present invention relates to a structure of a crimping connection part of an aluminum electric wire and a metal terminal, and a method for manufacturing the same, specifically to a corrosion prevention technology of a crimping connection part.

2. Description of the Related Art

For the purpose of achieving weight reduction of vehicles such as automobiles, attention is paid to the use of an aluminum or aluminum alloy electric wire (hereinafter generically named "aluminum electric wire"). The aluminum electric wire is formed by applying insulating sheath to a single wire core wire or a core wire obtained by twisting a plurality of aluminum wires. In the case of wirings of vehicles such as automobiles, a wire harness prepared by bundling a plurality of electric wires formed by crimp-connecting a metal terminal on both ends of an aluminum electric wire and arranging the shape in conformity with a wiring route is used.

For the metal terminal, in general, a copper or copper alloy terminal (hereinafter generically named "copper terminal") is used, and the aluminum electric wire is crimped by the copper terminal to obtain electrically connection. In that case, an open type wire barrel folded in a U-shape (core wire crimping part) is formed in a part of the copper terminal, the core wire formed by peeling off the insulating sheath of the end portion of the aluminum electric wire is located within the wire barrel, and the wire barrel is caulked to achieve crimping connection. In addition, an insulation barrel (insulating sheath crimping part) folded in a U-shape is formed on the end portion of the copper terminal, an insulating sheath of the end portion of the aluminum electric wire is located within the insulation barrel, and the insulation barrel is then caulked, thereby firmly crimping and holding the copper terminal on the aluminum electric wire (see, for example, JP-A-2010-108798, JP-A-2010-238393 and JP-A-2010-55901).

When moisture in the air is condensed and penetrates, or rainwater or the like penetrates into the crimping connection part between the aluminum electric wire and the copper terminal as thus crimp-connected, there is caused a problem of galvanic corrosion in which an ion of aluminum which is more easily oxidized elutes in correspondence to a difference of oxidation-reduction potential (ionization tendency) between the aluminum electric wire and the copper terminal as different metals from each other, thereby causing corrosion. Incidentally, in the case where a tin (Sn) plating is applied on the surface of the copper terminal, corrosion is similarly caused on the side of the aluminum electric wire due to a difference of oxidation-reduction potential between aluminum and tin. When the aluminum electric wire corrodes, there is caused such inconvenience that electrical characteristics of the connection part become instable due to an increase of contact resistance of the connection part, an increase of electrical resistance by a reduction of wire diameter, or the like.

Then, JP-A-2010-108798 proposes that a resin is coated on the entirety of the crimping connection part of the aluminum electric wire and the copper terminal, thereby preventing the penetration of water into the contact part of the aluminum electric wire and the copper terminal from occurring. In addition, JP-A-2010-238393 proposes that the crimping connection part of the aluminum electric wire and the copper terminal is covered by a metal housing body having a larger ionization tendency, namely a higher oxidation-reduction potential than that of aluminum and copper, and the metal housing body is sacrificially corroded, thereby suppressing the corrosion of aluminum. Furthermore, JP-A-2010-55901 proposes that a resin such as a silicone rubber is coated on an exposed core wire part from which the insulating sheath of the aluminum electric wire has been peeled off, to apply a waterproofing coating, the copper terminal is then crimped by a strong force to break the waterproofing coating, thereby bringing the aluminum electric wire and the copper terminal into contact with each other. According to this, the penetration of water into the contact part of the aluminum electric wire and the copper terminal is suppressed, whereby the corrosion of the aluminum core wire can be prevented from occurring.

SUMMARY OF THE INVENTION

Now, in the case of coating a resin on the entirety of the crimping connection part of the aluminum electric wire and the copper terminal as described in JP-A-2010-108798, after coating a flowable resin, light such as ultraviolet rays is irradiated to cure the resin. But, in view of the fact that the control of a coating amount or a thickness of the resin is difficult, there is involved such a problem that the inspection for all products must be carried out. In order to solve such a problem, it may be considered to integrally mold a resin coating surrounding the entirety of the crimping connection part of the aluminum electric wire and the copper terminal using a die; however, it is not practically useful to prepare a die for every electric wire size basis.

In addition, according to a method for covering by a metal housing body to be sacrificially corroded in the crimping connection part of the aluminum electric wire and the copper terminal as proposed in JP-A-2010-238393, since the size of the connection part becomes large, when the metal terminals having the connection arts are formed into a wire harness, a pitch between the adjacent metal terminals must be widened. For that reason, there is involved such a problem that a connector housing for housing a plurality of metal terminals side by side becomes large in size.

On the other hand, in the case of JP-A-2010-55901, since the resin such as a silicone rubber is an insulating material, there is a concern that even when the aluminum electric wire coated with the silicon rubber crimped by the copper terminal with a strong force, the coating made of the silicone rubber is not sufficiently broken, and a problem remains on the reliability of electrical contact between the aluminum electric wire and the copper terminal. In addition, the size of the connection part becomes large in accordance with a thickness of the silicone rubber coating. For that reason, since in a connector housing for housing a plurality of metal terminals side by side, a pitch between the adjacent metal terminals must be widened, there is involved such a problem that the size becomes large.

A problem to be solved by the present disclosure is to establish a corrosion prevention technology in which the manufacture control of an anticorrosive coating portion is easy, and the reliability of electrical contact between the aluminum electric wire and the metal terminal is not impaired without increasing the size of the crimping connection part.

In order to achieve the above object, according to the present disclosure, there is provided a structure of a crimping connection part of an aluminum electric wire and a metal terminal. The aluminum electric wire includes a core wire and an insulating sheath covering the core wire. An exposed core wire in which the core wire is exposed from the insulating sheath at an end portion of the aluminum electric wire is crimped by a core wire crimping part of the metal terminal to form the crimping connection part. The exposed core wire and the metal terminal of the crimping connection part are covered by a vapor deposited film comprised of an electrically conductive powder.

For example, an electrically conductive material of the electrically conductive powder is one of a metal material having an oxidation-reduction potential with a small difference from an oxidation-reduction potential of a metal material of the metal terminal, carbon, and gold.

For example, the metal terminal is a terminal formed of copper or a copper alloy, and a surface of the terminal is plated with tin, and an electrically conductive material of the electrically conductive powder is one of a metal material having an oxidation-reduction potential with a small difference from an oxidation-reduction potential of tin, carbon, and gold.

According to the present disclosure, there is also provided a method for manufacturing the above structure of the crimping connection part, the method comprising:

placing the crimping connection part, in which the exposed core wire of the aluminum electric wire is crimped by the metal terminal, within a vacuum vessel;

generating a vapor within the vacuum vessel by heating an electrically conductive material; and forming a vapor deposited film on the crimping connection part by condensing the vapor of the electrically conductive material.

According to the present disclosure, a corrosion prevention technology in which the manufacture control of an anticorrosive coating portion is easy, and the reliability of electrical contact between the aluminum electric wire and the metal terminal is not impaired without increasing the size of the crimping connection part can be established.

DETAILED DESCRIPTION OF THE EXEMPLARY EMBODIMENTS

A structure of a crimping connection part of an aluminum electric wire and a metal terminal of the present disclosure and a manufacture method thereof are hereunder described on the basis of embodiments.

Figure 2:
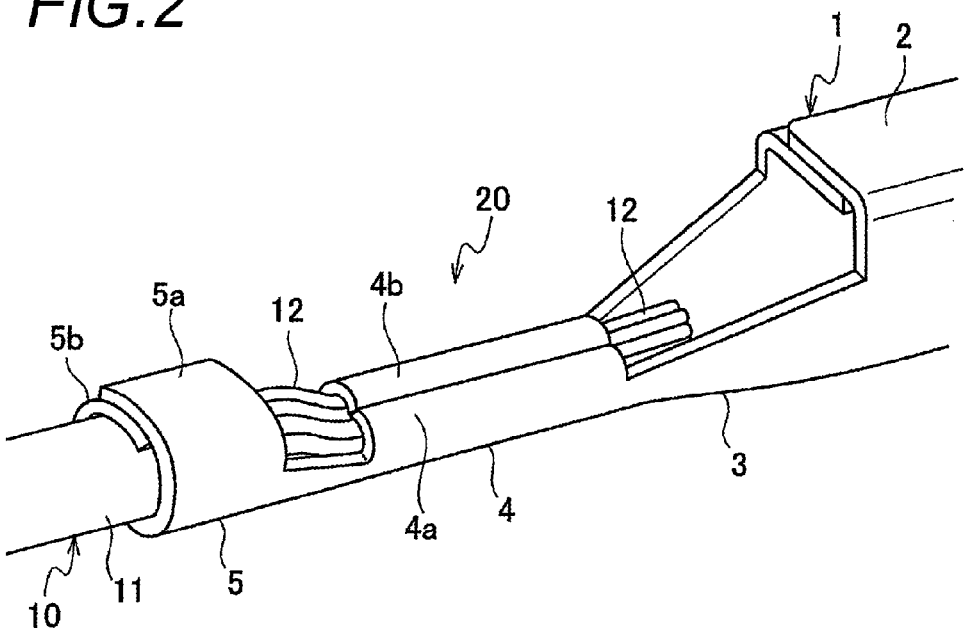
FIG. 2 is a perspective appearance view showing a configuration of a crimping connection part of an aluminum electric wire and a metal terminal according to an embodiment of the present disclosure.

A perspective appearance view of an example of a structure of a crimping connection part of an aluminum electric wire and a metal terminal is shown in FIG. 2. A copper terminal 1 as a metal terminal is formed by subjecting a plate material made of copper or a copper alloy to press processing. As shown in FIG. 2, the copper terminal 1 is formed so as to include a male-type or female-type housing terminal part 2, a coupling part 3 formed by extending a bottom plate and side plates of the tubular terminal part 2, and a wire barrel 4 as a core wire crimping part and an insulation barrel 5 as an insulating sheath crimping part, each of which is formed in the coupling part 3. The terminal part 2 is formed as a male-type or female-type terminal by folding a plate material in a housing form. The wire barrel 4 is formed so as to protrude a pair of barrel pieces 4*a* and 4*b* from both side edges of the plate material of the coupling part 3, and before caulking, the wire barrel 4 is formed as an open barrel having a U-shaped cross section. Similarly, the insulation barrel 5 is formed so as to protrude a pair of barrel pieces 5*a* and 5*b* from both side edges of the plate material of the coupling part 3, and before caulking, the insulation barrel 5 is formed as an open barrel having a U-shaped cross section. In parts of the coupling part 3 which are located between the terminal part 2 and the wire barrel 4 and between the wire barrel 4 and the insulation barrel 5, side walls are formed by folding the both side edges of the plate material. The copper terminal 1 is plated with tin (Sn).

In order to crimp-connect the copper terminal 1 to an aluminum electric wire 10, an insulating sheath 11 of an end of the aluminum electric wire 10 is first peeled off to expose a core wire 12. The exposed part of the core wire 12 is located at the wire barrel 4, and the both of the exposed part of the core wire 12 and the wire barrel 4 are caulked and the exposed part of the core wire 12 is crimped by the wire barrel 4 such that tips of the barrel pieces 4*a* and 4*b* are faced each other. In addition, the insulating sheath 11 of the end of the aluminum electric wire 10 is located at the insulation barrel 5, and the barrel pieces 5*a* and 5*b* are superimposed on and wound around the peripheral surface of the insulating sheath 11, followed by caulking. According to this, the aluminum electric wire 10 can be crimped by the copper terminal 1 and also firmly fixed thereto.

Figure 3:
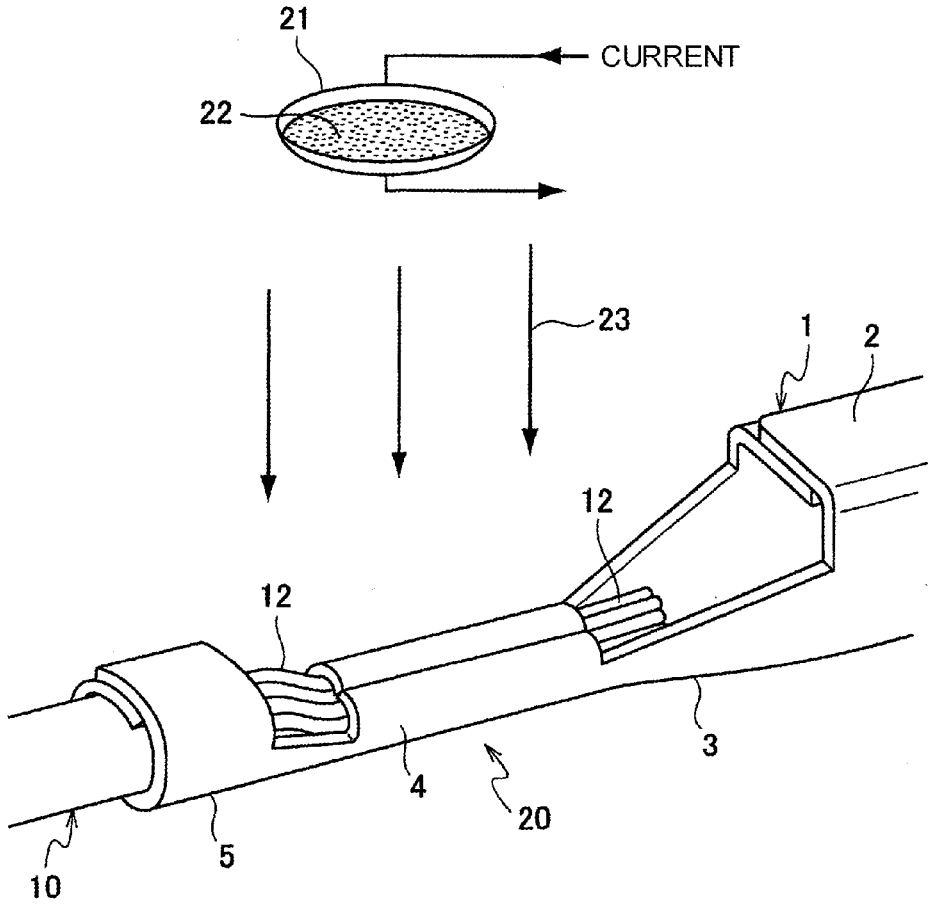
FIG. 3 is a schematic view showing a manufacture method of a crimping connection part of an aluminum electric wire and a metal terminal according to an embodiment of the present disclosure.

A manufacture method by cladding a vapor deposited film made of an electrically conductive powder on a crimping connection part 20 of the copper terminal 1 and the aluminum electric wire 10 as the crimp-connected part a vacuum vapor deposition is described by reference to FIG. 3. In FIG. 3, while illustration is omitted, the crimping connection part 20 of the copper terminal 1 and the aluminum electric wire 10 is held on a sample table provided within a vacuum vessel. Subsequently, the inside of the vacuum vessel is regulated to a prescribed vacuum pressure (for example, from $10^{-3}$ to $10^{-5}$ Pa), a current is flowed through an evaporation source 21 formed in, for example, a dish shape, to cause ohmic heating, and nickel 22 as one of electrically conductive materials housed in the evaporation source 21 is heat melted to produce a nickel vapor. The nickel vapor is condensed within the vacuum vessel to form a metal powder, and a flow 23 of the nickel vapor toward the crimping connection part 20 of the copper terminal 1 and the aluminum electric wire 10 is formed and comes into collision with and attaches onto the surface of the crimping connection part 20, thereby forming a vapor deposited film on the crimping connection part 20. A temperature in the vicinity of the crimping connection part 20 is adjusted to, for example, from about 60 to 100° C. by separating the crimping connection part 20 from the evaporation source 21 such that the insulating sheath 11 of the aluminum electric wire 10 is not damaged.

A thickness of the vapor deposited film can be controlled by adjusting a vapor deposition condition such as a vapor deposition time and a concentration of the nickel vapor. In addition, the flow 23 of an atom or molecule of the nickel vapor can be controlled by opening or dosing a partition provided between the crimping connection part 20 and the evaporation source 21. Furthermore, a vapor deposited film is not formed on an unnecessary portion of the crimping connection part 20 by covering the unnecessary portion with a shielding body or a shielding film. In addition, it is shown that the evaporation source 21 is arranged in an upper part of the vacuum vessel and the crimping connection part 20 which is subjective to the formation of the vapor deposited film is arranged in a lower part of the vacuum vessel as shown in FIG. 3. However, the top and bottom relation of the evaporation source 21 and the crimping connection part 20 in the location may be reversed.

Figure 1:
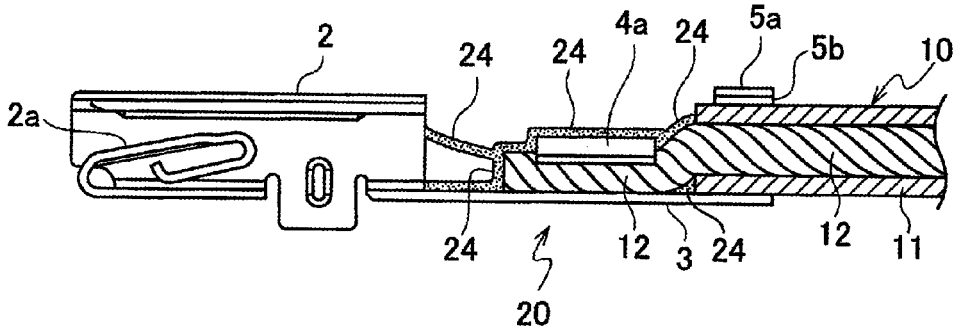
FIG. 1 is a cross-sectional view showing a structure of a crimping connection part of an aluminum electric wire and a metal terminal according to an embodiment of the present disclosure.

A structure of the crimping connection part 20 of the aluminum electric wire 10 and the copper terminal 1 according to an embodiment of the present disclosure, in which a vapor deposited film made of a nickel powder is thus formed, is shown in FIG. 1. FIG. 1 is a cross-sectional view showing the structure of the crimping connection part 20 which is cut by a vertical plane including a major axis of the aluminum electric wire 10 and the copper terminal 1. In this embodiment, the crimping connection part 20 in a state that the aluminum electric wire 10 is crimped by the copper terminal is subjected to vacuum vapor deposition to from the vapor deposited film of nickel on the crimping connection part 20. That is, as shown in FIG. 1, the exposed part of the core wire 12 of the aluminum electric wire 10 is crimp-connected with the coupling part 3 by caulking the barrel pieces 4*a* and 4*b* of the wire barrel 4 of the copper terminal 1. In addition, the end of the insulating sheath 11 of the aluminum electric wire 10 is fixed to the coupling part 3 by caulking the barrel pieces 5*a* and 5*b* of the insulation barrel 2. Incidentally, in this embodiment, while a female-type terminal provided with a curved elastic deformable contact 2*a* is used as the terminal part 2, the present disclosure is not limited thereto but it is similarly applicable to a male-type terminal as the terminal part 2.

Next, a characteristic configuration of the present disclosure is described by reference to FIG. 1. As a result of subjecting the crimping connection part 20 to vapor deposition of nickel by using the vacuum vapor deposition as explained in FIG. 3, a vapor deposited film 24 made of a nickel powder is formed on an outer surface of the copper terminal 1 and an outer surface of the exposed core wire 11 of the aluminum electric wire 10 which constitute the crimping connection part 20. Though a thickness of the vapor deposited film 24 to be actually formed can be made extremely thin, the thickness of the vapor deposited film 24 is shown in an exaggerated way in FIG. 1. As illustrated in FIG. 1, the vapor deposited film 24 covers the peripheral surface and cut surface of the exposed core wire 11 and also covers the outer surfaces and end surfaces of the barrel pieces 4*a* and 4*b*, and furthermore, the vapor deposited film 24 is vapor deposited on the outer surface of the coupling part 3. Incidentally, the vapor deposited film may be formed on the outer surface and end surface of the insulation barrel 5, the outer surface of the insulation coating 11 in the vicinity of the insulation barrel 5, and the outer surface of the terminal part 2, and the like. This embodiment is concerned with an example in which the above portions are covered by a shielding body so as to avoid forming a vapor deposited film thereon.

As described above, according to this embodiment, since the crimping connection part 20 of the copper terminal 1 and the aluminum electric wire 10 is covered by the vapor deposited film 24 made of the nickel powder, a fine gap of the crimping connection part 20 between the peripheral surface and cut surface of the core wire 12 of the aluminum electric wire 10 and the copper terminal 1 can be filled with the vapor deposited film made of the nickel powder. As a result, the penetration of water into the crimping connection part 20 is suppressed, whereby the corrosion of the aluminum core wire can be prevented from occurring. In addition, since the surface of the exposed part of the core wire 12 of the aluminum electric wire 10 is covered by the vapor deposited film made of the nickel powder, the contact part or boundary part between aluminum and the tin plating of the copper terminal is not exposed. As a result, even when water is present in the crimping connection part 20 and surroundings thereof, electric corrosion of aluminum is hardly caused.

In addition, since the vapor deposited film 24 is formed as an anticorrosive coating film by vacuum vapor deposition, by adjusting a vacuum vapor deposition condition (for example, a vapor concentration or a vapor deposition time of the electrically conductive material), a thickness of the vapor deposited film can be freely controlled, for example, in the order of μm unit. As a result, the manufacture control of an anticorrosive coating film is easy, and the anticorrosive coating film can be formed without increasing the size of the crimping connection part 20. For that reason, the corrosion prevention of the aluminum electric wire can be realized without increasing the size of a terminal housing chamber of a connector housing for housing a plurality of copper terminals side by side. Furthermore, since the vapor deposited film 24 is made of a nickel powder, the reliability of electrical contact between the aluminum electric wire 10 and the copper terminal 1 is not impaired.

In the above embodiment, the vapor deposited film 24 is formed of nickel, however, it should not be construed that the present disclosure is limited thereto, and the vapor deposited film 24 can be formed by using carbon or the like, in addition to a metal such as tin and gold. In addition, not only the copper terminal but also other metal terminals can be applied. In the case of a vapor deposited film made of a metal powder, a metal material having a small oxidation-reduction potential difference from the metal of the metal terminal is chosen. According to this, even when water is present in an exposed part at the boundary between the vapor deposited film made of a metal powder and the metal terminal, the occurrence of electric corrosion can be prevented.

In addition, in the foregoing embodiment, while an example of a copper terminal made of copper or a copper alloy, the surface of which is plated with tin, has been described, the present disclosure can also be applied to a copper terminal not plated with tin.

Here, the detail of the above embodiment is summarized as follows.

In a structure of a crimping connection part of an aluminum electric wire and a metal terminal, the aluminum electric wire includes a core wire and an insulating sheath covering the core wire, an exposed core wire in which the core wire is exposed from the insulating sheath at an end portion of the aluminum electric wire is crimped by a core wire crimping part of the metal terminal to form the crimping connection part, and the exposed core wire and the metal terminal of the crimping connection part are covered by a vapor deposited film comprised of an electrically conductive powder.

For example, the vapor deposited film comprised of the electrically conductive powder can be formed using a metal such as nickel, tin, and gold and besides, carbon or the like. Such a vapor deposited film can be formed by means of well-known vacuum vapor deposition, and by adjusting a vacuum vapor deposition condition (for example, a vapor concentration or a vapor deposition time of the electrically conductive material), a thickness of the vapor deposited film can be freely controlled, for example, in the order of μm unit. In addition, since a fine gap in the crimping connection part between the peripheral surface of the core wire of the aluminum electric wire and the metal terminal can be filled with the electrically conductive powder, the corrosion of the aluminum core wire of the crimping connection part can be prevented from occurring by suppressing the penetration of water. Incidentally, since the surface of the exposed core wire of the aluminum electric wire is covered by the vapor deposited film comprised of the electrically conductive powder, a contact part or boundary part of the different metals from each other is not exposed, so that even when water is present in the crimping connection part and surroundings thereof, electric corrosion is hardly caused. As a result, since the manufacture control of an anticorrosive coating film is easy, and also, the anticorrosive coating film can be formed thin, the anticorrosive coating film can be formed without increasing the size of the crimping connection part. In addition, since the vapor deposited film has electrical conductivity, the reliability of electrical contact between the aluminum electric wire and the metal terminal is not impaired.

In the present disclosure, for example, the electrically conductive powder for forming the vapor deposited film is an electrically conductive material selected among a metal material having an oxidation-reduction potential with a small difference from an oxidation-reduction potential of the metal material of the metal terminal, carbon, and gold. According to this, even when water is present in an exposed part at the boundary between the vapor deposited film made of a metal powder and the metal terminal, the occurrence of electric corrosion can be prevented.

Here, needless to say, the present disclosure can be applied to a metal terminal made of copper or a copper alloy. In addition, in the case where the present disclosure is applied to a metal terminal made of copper or a copper alloy, the surface of which has been plated with tin, the electrically conductive powder constituting the metal vapor deposited film can be made an electrically conductive material selected among a metal material having an oxidation-reduction potential with small difference from an oxidation-reduction potential of tin (for example, tin or nickel), carbon, and gold.

The vapor deposited film made of the electrically conductive powder can be formed by placing the crimping connection part, in which the metal terminal is caulked and connected with the foregoing exposed core wire of the aluminum electric wire, within a vacuum vessel, providing a vapor source for heating an electrically conductive material to produce a vapor, within the vacuum vessel, and condensing the vapor of the electrically conductive material produced from the vapor source and vapor depositing it in the foregoing crimping connection part.

In addition, instead thereof, after a vapor deposited film made of an electrically conductive powder is formed on a core wire-exposed part of the aluminum electric wire and a core wire-cut surface by means of vacuum vapor deposition, a copper terminal can be crimp-connected. However, in the case, since there is a concern that the vapor deposited film made of an electrically conductive powder is peeled off by a crimping pressure, it is preferable to subject the vapor deposited film made of an electrically conductive powder to vacuum vapor deposition after crimping.

By the above disclosure, a corrosion prevention technology in which the manufacture control of an anticorrosive coating portion is easy, and the reliability of electrical contact between an aluminum electric wire and a metal terminal is not impaired without increasing the size of the crimping connection part can be achieved.

What is claimed is:

1. A structure of a crimping connection part of an aluminum electric wire and a metal terminal, wherein the aluminum electric wire includes a core wire and an insulating sheath covering the core wire;

wherein an exposed core wire in which the core wire is exposed from the insulating sheath at an end portion of the aluminum electric wire is crimped by a core wire crimping part of the metal terminal to form the crimping connection part; and wherein the exposed core wire and the metal terminal of the crimping connection part are covered by a vapor deposited film comprised of an electrically conductive powder.

2. The structure of the crimping connection part according to claim 1, wherein an electrically conductive material of the electrically conductive powder is a metal material having an oxidation-reduction potential with a small difference from an oxidation-reduction potential of a metal material of the metal terminal.

3. The structure of the crimping connection part according to claim 1, wherein the metal terminal is a terminal formed of copper or a copper alloy, and a surface of the terminal is plated with tin; and wherein an electrically conductive material of the electrically conductive powder is one of a metal material having an oxidation-reduction potential with a small difference from an oxidation-reduction potential of one from among tin, carbon, and gold.

4. A method for manufacturing the structure of the crimping connection part according to claims 1, comprising:

placing the crimping connection part, in which the exposed core wire of the aluminum electric wire is crimped by the metal terminal, within a vacuum vessel;

generating a vapor within the vacuum vessel by heating an electrically conductive material; and forming a vapor deposited film on the crimping connection part by condensing the vapor of the electrically conductive material.

5. The structure of the crimping connection part according to claim 2, wherein the metal material of the metal terminal comprises at least one from among copper, carbon, tin, and gold.

6. The structure of the crimping connection part according to claim 1, wherein the film is vapor deposited to cover both the exposed core wire and the metal terminal of the crimping connection part while the exposed core wire is crimped by the core wire crimping part.

7. The structure of the crimping connection part according to claim 1, wherein the film covers both the exposed core wire and the metal terminal of the crimping connection part such that a boundary between different metals is not exposed.

8. The structure of the crimping connection part according to claim 1, wherein the film covers the exposed core wire and the metal terminal of the crimping connection part such that a penetration of water into the crimping connection part is suppressed.

9. A crimping connection part comprising:

a core wire crimping part of a metal terminal;

an exposed core wire, in which a core wire is exposed from an insulating sheath at an end portion of an aluminum electric wire, the exposed core being crimped by the core wire crimping part of the metal terminal to form the crimping connection part; and a vapor deposited film comprised of an electrically conductive powder covering both the exposed core wire and the metal terminal of the crimping connection part.

10. The crimping connection part according to claim 9, wherein the vapor deposited film is deposited to cover both the exposed core wire and the metal terminal of the crimping connection part while the exposed core wire is crimped by the core wire crimping part.

11. The crimping connection part according to claim 9, wherein the film covers both the exposed core wire and the metal terminal of the crimping connection part such that a boundary between different metals is not exposed.

12. The crimping connection part according to claim 9, wherein the film covers the exposed core wire and the metal terminal of the crimping connection part such that a penetration of water into the crimping connection part is suppressed.

* * * * *